US005205647A

United States Patent [19]

Ricciardi

[11] Patent Number: 5,205,647

[45] Date of Patent: Apr. 27, 1993

[54] FLUID MIXING APPARATUS AND METHOD OF MIXING

[75] Inventor: Ronald J. Ricciardi, Woodclifflake, N.J.

[73] Assignee: Acrison, Inc., Moonachie, N.J.

[21] Appl. No.: 773,419

[22] Filed: Oct. 9, 1991

[51] Int. Cl.[5] ..... B01F 5/12

[52] U.S. Cl. ..... 366/176; 366/306

[58] Field of Search ..... 366/176, 150, 173, 244, 366/245, 99, 279, 305, 307, 239, 330, 270, 316, 306

[56] References Cited

U.S. PATENT DOCUMENTS 1,807,773 6/1931 Dawson ..... 366/176

*Primary Examiner*—Robert W. Jenkins

*Attorney, Agent, or Firm*—Davis, Hoxie, Faithfull & Hapgood

[57] ABSTRACT

A mixing apparatus for mixing two or more fluids into a homogeneous mixture. A rotor is mounted on a drive shaft coaxially within a cylindrical casing. Bores run the length of the rotor. Mixing conduits lead from the bores to outside the rotor. A cylindrical sleeve with slots is mounted coaxially within the casing and encloses the rotor. The fluids to be mixed are introduced into one end of the casing within the sleeve while the rotor is rotating. The fluids are sheared as they enter into the bores. The combined fluid either passes out of the mixing conduits near the front of the casing where it is sheared again or passes further along the bore to exit mixing conduits near the rear of the casing. The fluid then passes through the slots in the sleeve, where it is sheared again. Finally, the mixed fluid exits the other end of the casing.

20 Claims, 4 Drawing Sheets

FLUID MIXING APPARATUS AND METHOD OF MIXING

FIELD OF THE INVENTION

The present invention relates to an apparatus and method for mixing fluids.

BACKGROUND OF THE INVENTION

Many industrial processes require the mixing of different fluids or the dilution of one fluid with another. For example, liquid polyelectrolytes used in various water treatment processes must sometimes be diluted with water in a volumetric proportion typically of 200 to 1 for commercial applications, but this can vary. Due to the large amount of water diluent required, it is often significantly less expensive to transport only the polyelectrolyte and to mix the fluids on site, so that the transportation cost is substantially reduced. Many liquid polyelectrolytes are generally not easy to mix with water of their high viscosity and/or chemistry which inhibits mixing. In other instances, processes require mixing a single fluid such that it is homogeneous before the fluid can be used.

Generally, when two different fluids are mixed, such as a liquid polyelectrolyte and water, each fluid is initially in a region composed purely of itself, surrounded by another region composed purely of the other fluid. In order to mix the fluids, the regions are brought together. A mixing surface area exists between the two pure regions. Mixing results as molecules from one pure region transfuse into the other pure region This can happen only at the mixing surface. Consequently, increasing the mixing surface area per unit volume accelerates mixing for a particular volume of a fluid in a diluent. Generally, the total surface area per unit volume is increased as a single volume of one fluid is divided into more smaller volumes.

An increase in mixing surface area can be achieved by introducing a shear force to the fluid in a diluent. This shear force moves part of the fluid at a different velocity than other parts of the fluid, breaking up the single pure region into more, volumetrically smaller regions. As a result, the mixing surface area per unit volume for the particular fluid volume is increased.

Shear can be introduced to a fluid in several ways. One way to introduce shear is to draw a member through the fluids, mechanically breaking up the pure region. This is similar to stirring oil and vinegar with a spoon. Another way to introduce shear into a fluid is by creating turbulence in the fluid. The turbulence creates fluid streams of different speeds and directions, operating to move parts of the pure region in different directions simultaneously, thereby creating more smaller pure regions and, thus increasing the mixing surface area per unit volume of fluid. When a fluid has a high viscosity, such as with a liquid polyelectrolyte, it is more reluctant to be broken up into smaller regions. Consequently, mixing is more difficult.

In certain applications requiring viscous polyelectrolyte fluids to be diluted in water, the mixed solution must be substantially homogeneous. Further, the mixing should be done in a short time so that the mixture can be used at once without requiring significant storage space to allow time for the mixture to "age."

One apparatus for mixing liquid polyelectrolytes and water is shown in U.S. Pat. No. 4,886,368 to L. Tony King, which describes a device that "smears" the two fluids, proposing to increase the mixing surface area per unit volume by introducing the liquid polyelectrolyte to the water as a thin film, without much thickness. In the '368 patent, a drive shaft rotates within a cylindrical chamber. Grooves on the outer circumference of the drive shaft run the length of the chamber. The space between the outer diameter of the drive shaft and the wall of the chamber is small, i.e., on the order of 0.005 inches. Water is introduced into the chamber, flowing over the drive shaft and through the grooves and out of an outlet hole at the rear of the chamber. A liquid polyelectrolyte is introduced radially into the chamber at a point intermediate the chamber and the drive shaft. Because the annular gap region between the drive shaft and the wall of the chamber is so small, the '368 patent states that water and the polyelectrolyte are "smeared" together, i.e., a thin layer of polyelectrolyte and a thin layer of water are pressed together, inducing mixing.

SUMMARY OF THE INVENTION

The mixer of the present invention provides an apparatus that quickly mixes fluids of high viscosity into a homogeneous solution. The mixing apparatus can also mix a single fluid that has settled such that the fluid is substantially homogeneous. The mixing apparatus subjects all of the viscous fluid to sufficiently high shear stresses at various points in the mixing process so that there is no clumping or agglomeration. The term "fluid" as used herein refers to any material that can flow, including solids suspended in a fluid as well as pure liquids.

It is an object of this invention to provide a mixing apparatus that mixes viscous fluids into a homogeneous solution. It is another object of this invention to provide a mixing apparatus that produces a homogeneous solution in a short period of time. It is another object of this invention to provide a mixing apparatus that mixes water and liquid polyelectrolyte into a homogeneous solution. It is another object of this invention to provide a mixing apparatus that does not permit viscous fluid to pass through the apparatus without being mixed.

The mixing apparatus of the present invention comprises a rotor and a casing. Bores run the length of the rotor. Mixing conduits lead from the bores to outside the rotor. The rotor is rotationally mounted in the casing. There are inlet holes for the polyelectrolyte and the water at one end of the casing and an outlet hole at the other end of the casing. The polyelectrolyte and water are introduced through the inlet holes as the rotor is rotating. The fluids are forced by fluid pressure through the bores of the rotor. Fluid pressure and centrifugal force cause the fluids to flow through the mixing conduits. Finally, fluid pressure forces the mixture out of the outlet hole. As the fluids enter the bores and exit the mixing holes, they are subjected to shear stress. At all stages within the chamber, the fluids are subjected to turbulence. A sleeve is mounted within the casing about the rotor. The sleeve encloses the inlet holes but not the outlet hole. Slots are located at points along the sleeve. As the fluid exits the mixing conduits, it is rotated within the sleeve by the rotor. The fluid is then forced out of the slots by fluid pressure where it is subjected to shear forces that further increase mixing. Consequently, as the mixture exits the outlet hole, the mixture is substantially homogeneous.

BRIEF DESCRIPTION OF THE DRAWINGS

In the drawings, which are illustrative of an embodiment of the invention.

DETAILED DESCRIPTION

Figure 1:
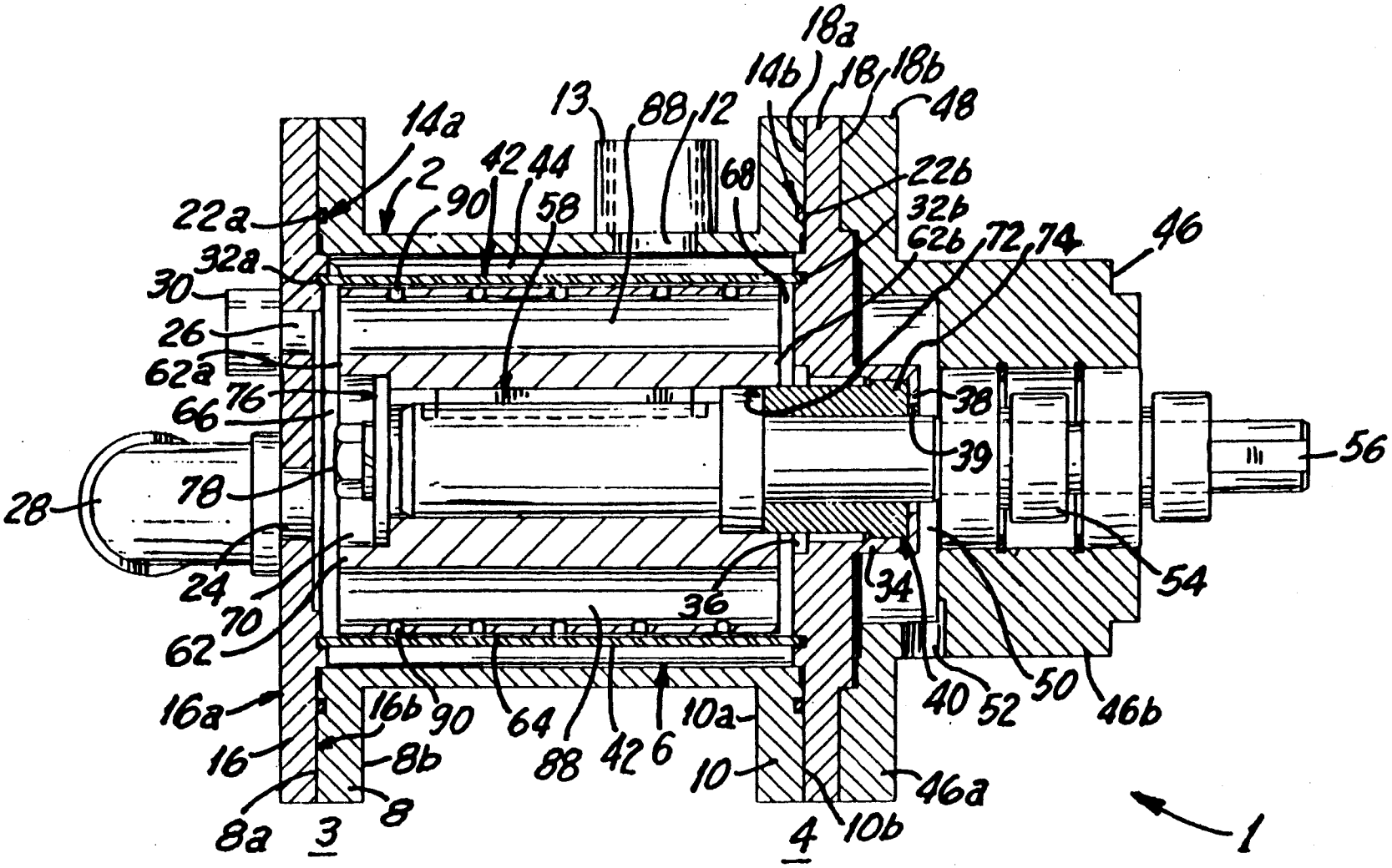
FIG. 1 is a partial cut-away side elevational view of the mixing apparatus of the present invention.

FIG. 1 shows a partial cut-away side elevational view of a preferred embodiment of the mixer 1 of the present invention. The mixer 1 comprises a rotor 62 rotationally mounted within a cylindrical casing 2. The cylindrical casing 2 has a central opening and defines the outer walls of the mixer 1. The casing 2 is composed of any noncorroding material such as 304 stainless steel. The walls of the casing 2 define a rotor chamber 6 which extends from a front end 3 of the casing 2 to a rear end 4 of the casing 2, encompassing all the space within the wall of the casing 2. Portions of the wall of the casing 2 are flanged out radially from the axis of the casing at both ends 3 and 4 to form a front flange 8 and a rear flange 10 that are flat rings having front faces 8*a*, 10*a* and rear faces 8*b*, 10*b*, respectively. The flanges 8, 10 are of equal outer diameter and are sufficiently thick to allow for the mounting of a bolt. A radial mixture outlet opening 12 is cut into the wall proximate to the rear flange 10 near the top of the casing 2. A mixture outlet pipe 13 is mounted in the mixture outlet 12. As described below, mixture outlet 12 serves as the conduit for the mixed fluid polyelectrolyte and water.

There are circular grooves 14*a*, 14*b* in the front face 8*a* of the front flange 8 and in the rear face 10*b* of the rear flange 10, respectively, positioned near the wall of the casing 2. The centers of the grooves 14*a*, 14*b* are coincident with the axis of the casing 2. As described below, the grooves 14*a*, 14*b* hold O-rings 22*a*, 22*b* in position, sealing the joint between the front flange 8 and a front plate 16 and the joint between the rear flange 10 and a rear plate 18.

The front end 3 and the rear end 4 of the casing 2 are capped by the front plate 16 and the rear plate 18, respectively. The front plate 16 is a disc having a front face 16*a* and a rear face 16*b* with an outer diameter of the same dimension as the outer diameter of the front flange 8 of the casing 2. The front plate 16 is bolted onto the front flange 8 of the casing 2 at several equally-spaced points (6 bolts 20 in FIG. 2). An O-ring 22*a* sits tightly in the groove 14*a* of the front flange 8, sealing the joint between the front plate 16 and the front flange 8. The O-ring 22*a* prevents any fluid from leaking out of the mixer 1 between the front flange 8 and the front plate 16.

There are two inlet openings in the front plate 16 that extend completely through the front plate, namely a first inlet 24 that serves as the water inlet and second inlet 26 that serves as the liquid polyelectrolyte inlet. As used here, "fluid" includes any material that flows, including solids suspended in a fluid. While two inlets are shown in the preferred embodiment, it should be understood that the mixer i works equally well with additional inlets, for example, wherever three or more fluids must be mixed. Further, a single inlet could be used in order to mix a single fluid so that it becomes substantially homogeneous. The water inlet 24 is substantially larger in diameter than the polyelectrolyte inlet 26. In the embodiment shown in the figures, the diameter of the water inlet 24 is two times the diameter of the polyelectrolyte inlet 26. A water inlet connection 28 is mounted on the front face 16*a* of the front plate 16 about the water inlet 24. Similarly, a polyelectrolyte inlet tube 30 is mounted on the front face 16*a* of the front plate 16 about the polyelectrolyte inlet 26.

The water inlet 24 is located near the center of the front plate 16 although not necessarily concentric with the front plate 16. The polyelectrolyte inlet 26 is located near the wall of the casing 2, such that the polyelectrolyte inlet 26 is completely contained between the wall and the axis of the casing 2.

A circular front notch 32*a* sits in the rear face 16*b* of the front plate 16. The center of the front notch 32*a* is coincident with the axis of the casing 2. The inner diameter of the front notch 32*a* encloses completely both the water inlet 24 and the polyelectrolyte inlet 26. The outer diameter of the front notch 32*a* is enclosed within the rotor chamber 6. As described below, the front notch 32*a* is used to support a sleeve 42 within the casing 2.

The rear end 4 of the casing 2 is capped by the rear plate 18. The rear plate 18 is a disc with a front face 18*a* and a rear face 18*b*, each face having an outer diameter of the same dimension as the outer diameter of the rear flange 10 of the casing 2. An O-ring 22*b* is seated in the rear groove 14*b* in the rear face 10*b* of the rear flange 10 and fittingly engaged with the rear flange 10 and the rear plate 18 such that the joint between the rear plate 18 and the rear flange 10 of the casing 2 is sealed. Consequently, no fluid can leak between the rear flange 10 and the rear plate 18.

A seal footing 34 is mounted on the rear plate 18. The seal footing 34 is a cylindrical cup with a mouth 36 at the front face 18*a* of the rear plate 18, a base 38 and a cylindrical cup wall 40 whose axis is coincident with the axis of the casing 2. The seal footing wall 40 extends rearwardly from the mouth 36 beyond the rear face 18*b* of the rear plate 18 to the base 38. The base 38 is a disc mounted on the seal footing wall distal to the mouth 36. There is a circular drive shaft hole 39 in the base 38. The center of the drive shaft hole 39 is coincident with the axis of the casing 2. A drive shaft 56 runs axially within the casing 2 rearwardly through the drive shaft hole 39. As described below, a cylindrical seal 74 is mounted within the seal footing 34 about the drive shaft 56. The seal 74 prevents fluid from flowing outside the casing 2 but does not hinder rotation of the drive shaft 56.

There is a circular rear notch 32*b* in the front face 18*a* of the rear plate 18. The center of the rear notch 32*b* is coincident with the axis of the casing 2. The inner diameter of the rear notch 32*b* encloses the mouth 36 of the seal footing 34. The outer diameter of the rear notch 32*b* is within the rotor chamber 6. The front notch 32*a* and the rear notch 32*b* are located the same distance from the axis of the casing 2 so that the cylindrical sleeve can be mounted coaxially with the casing 2.

Figure 6:
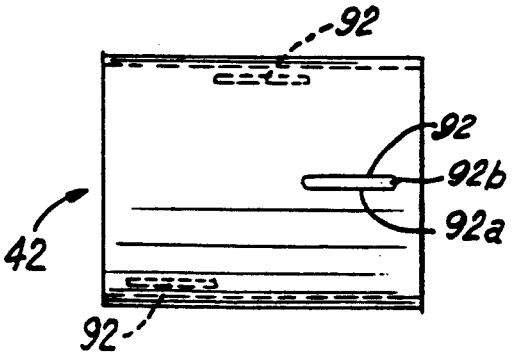
FIG. 6 is a side view in isolation of the sleeve of the mixing apparatus of FIG. 1.
Figure 7:
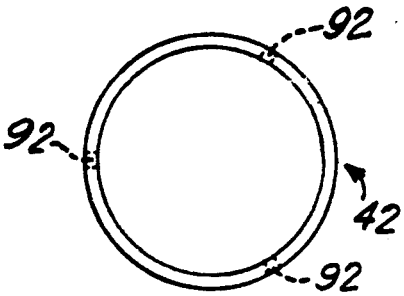
FIG. 7 is a front view of the sleeve of FIG. 6.

The cylindrical sleeve 42, best seen in FIGS. 1 and 6–7, is a thin-walled tube of non-corrosive material such as 304 stainless steel. The sleeve 42 is mounted in the rotor chamber 6. Edges of the sleeve 42 fit tightly into the front notch 32*a* and the rear notch 32*b*. The sleeve 42 is coaxial with the casing 2 and has an outer diameter smaller than the rotor chamber 6. Consequently, a mixing zone 44 is created between the sleeve 42 and the wall of the casing 2.

A drive shaft housing 46 having a front portion 46*a* and a rear portion 46*b* is mounted onto the rear plate 18. The drive shaft housing 46 is a cylinder coaxial with the casing 2. The front portion 46*a* of the drive shaft housing 46 is flanged radially into a drive shaft flange 48 that has the same outer diameter as the rear plate 18 and the rear flange 10. The rear flange 10, the rear plate 18 and the drive shaft flange 48 are all bolted together at several equally-spaced points.

There is a drive shaft chamber 50 that extends the length of the drive shaft housing 46 coaxial with the drive shaft housing 46 and the casing 2. At the front portion 46*a*, the drive shaft chamber 50 is large enough to envelope the seal footing 34. When the drive shaft housing 46 is mounted onto the rear plate 18, the seal footing 34 is located within the drive shaft chamber 50 at the front portion 46*a* of the drive shaft housing 46. A seal wear detection hole 52 is located in the front portion 46*a* of the drive shaft housing 46 directly beneath a rear face 38*a* of the base 38 of the seal footing 34.

The radius of the drive shaft chamber 50 is reduced in the rear portion 46*b* of the drive shaft housing 46. A ball bearing support 54 is mounted within the drive shaft chamber 50 at the middle of the rear portion 46*b*.

The drive shaft 56 is mounted on the ball bearing support 54 such that the drive shaft 56 is free to rotate about the axis of the casing 2. The ball bearing support 54 prevents the drive shaft 56 from bending out of line with the axis of the casing 2.

The drive shaft 56 runs along the axis of the casing 2 through the rotor chamber 6, the seal 74, the hole 39 in the base 38 of the seal footing 34, and the drive shaft chamber 50, terminating beyond the rear of the drive shaft housing 46. Mounted at the outer diameter of the drive shaft 56, at the portion of the drive shaft 56 within the rotor chamber 6, a key 58 protrudes radially from the drive shaft 56. As described below, the key 58 prevents a rotor 62 from rotating with respect to the drive shaft 56.

The drive shaft 56 is operably connected to a motor 60 of sufficient horsepower to rotate the shaft at 1100 rpm. While the motor 60 rotates the drive shaft 56 in the embodiment shown in the figures, any rotation means would suffice to practice the invention.

Figure 3:
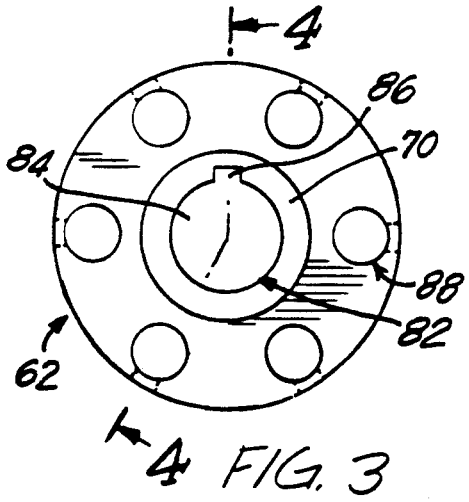
FIG. 3 is a front elevational view in isolation of a rotor of the mixing apparatus of FIG. 1.
Figure 4:
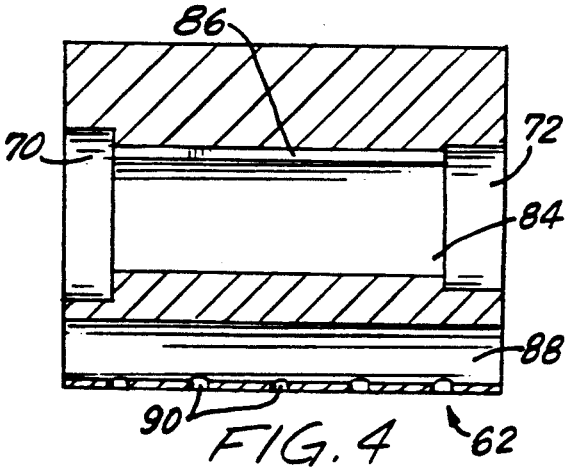
FIG. 4 is a cut-away side elevational view along lines 4—4 of FIG. 3.
Figure 5:
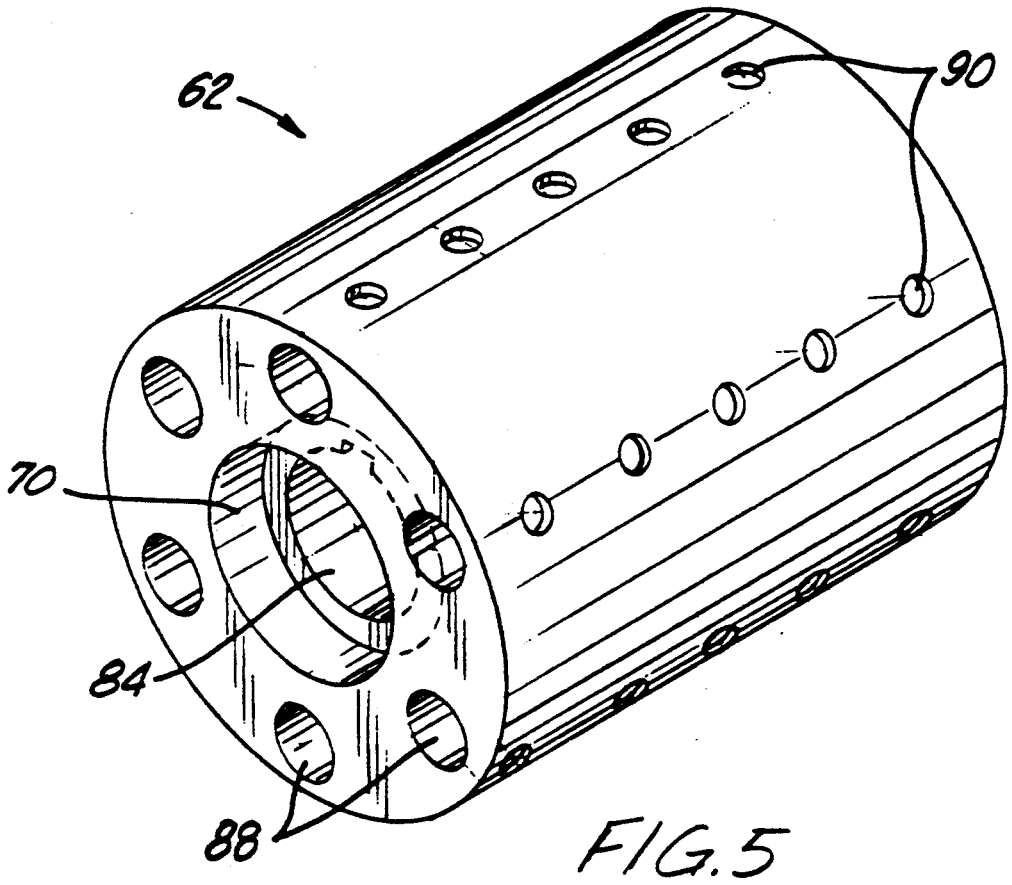
FIG. 5 is a perspective view of the rotor of FIG. 3.

A substantially cylindrical rotor 62, best seen in FIGS. 3–5, is mounted coaxially on the drive shaft 56 within the sleeve 42 in the rotor chamber 6 of the casing 2. The outer diameter of the rotor 62 is less than the inner diameter of the sleeve 42 (about ⅛ inch less) such that a cylindrical mixing region 64 is formed between the outer wall of the rotor 62 and the inner wall of the sleeve 42. The rotor 62 is not as long in the axial direction as the rotor chamber 6. Consequently, a pre-rotor cavity 66 and a post-rotor cavity 68 are formed between the rotor 62, the sleeve 42, and the front and rear plates 16, 18, respectively.

The rotor 62 has a front end 62*a* and a rear end 62*b*. At the ends 62*a*, 62*b* of the rotor 62, a front cup 70 and a rear cup 72 are created by cylindrical holes located at each end. The cups 70, 72 have larger outer diameters than the drive shaft 56 and are coaxial with the rotor 62.

The seal 74 is mounted in the seal footing 34. The seal 74 is a cylindrical tube that is positioned within the inside of the wall 40 of the seal footing 34. The seal 74 envelopes the drive shaft 56 but does not hinder rotation. The seal 74 is tightly fit into sealing engagement with the rear cup 72 of the rotor 62 such that there can be no fluid flow between the seal 74 and the rear cup 72.

At the rear cup 72, the drive shaft 56 is flanged to fit tightly within the rear cup 72 in front of the seal 74, thereby preventing the rotor 62 from sliding back along the drive shaft 56. A washer 76 is seated snugly in the front cup 70. A bolt 78 is screwed into the end of the drive shaft 56. The bolt 78 holds the washer 76 against the front cup 70, thereby preventing the rotor 62 from sliding off the front of the drive shaft 56.

Cylindrical bores 88 with circular cross sections of equal radii run the entire length of the rotor 62 parallel to the axis of the rotor. The centers of the bores 88 are located an equal distance from the axis of the rotor 62. The bores 88 are positioned the same distance from the axis of the casing as the polymer inlet 26. Consequently, as the rotor 62 is rotated, each bore 88 will periodically line up directly adjacent to the polymer inlet 26.

Figure 2:
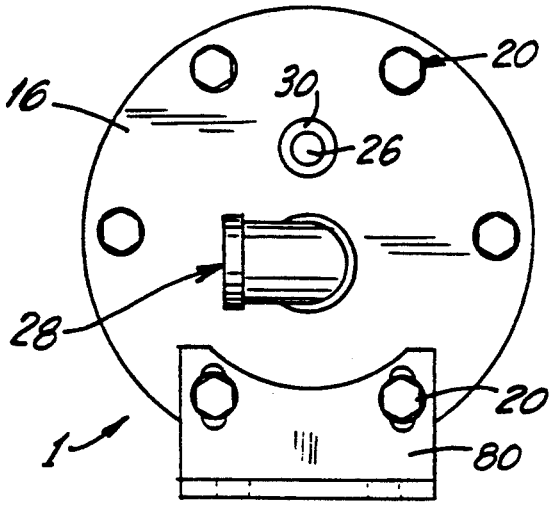
FIG. 2 is a front elevational view of the mixing apparatus of FIG. 1

FIG. 2 shows a front elevational view of the mixer 1. Bolts 20 are equally spaced along a circumference of the front plate 16. The front plate 16 is bolted onto a stand 80. The stand 80 can be bolted to a point where the user intends to operate the mixer 1, such as a workroom floor. The water inlet connection 28 is mounted near the center of the front plate 16. The polymer inlet tube 30 is mounted closer to the outer diameter of the front plate 16 than the water inlet hose 28 and directly above the water inlet hose 28. While the inlets are located in vertical line in the embodiment shown in the figures, it should be noted that the inlet holes 24, 26 may be located anywhere in the casing 2 or the front plate 16 as long as the fluids are introduced into the rotor chamber 6 before the rotor 62, i.e., into the pre-rotor cavity 66.

FIG. 3 is a front elevational view in isolation of the rotor 62. A mounting hole 82 is located in the center of the rotor 62 and comprises a cylindrical mounting chamber 84 that is coaxial with the rotor 62, extending from the front cup 70 to the rear cup 72 (FIG. 4). A key trough 86, which is a groove with a substantially rectangular cross section, is cut into the rotor 62 and is located at the outer diameter of the mounting chamber 84. The key trough 86 extends from the front cup 70 to the rear cup 72 (FIG. 4). The key trough 86 is slightly larger than the key 58 of the drive shaft 56 such that when the rotor 62 is mounted on the drive shaft 56, the key 58 fits snugly within the key trough 86 and the drive shaft 56 fits snugly within the mounting chamber 84.

Six bores 88 run the length of the rotor 62. The centers of the bores 88 are equally spaced 60° from one another. The bores 88 are located at a point in the rotor 62 such that when the rotor 62 is in place within the casing 2, the bores are the same distance from the axis of the casing as the polymer inlet 26. The diameter of the bores 88 are such that they do not overlap either the front cup 70, the rear cup 72, or each other, and the bores do not extend to the outer cylindrical wall of the rotor 62. While six bores 88 are used in the preferred embodiment, a different number of bores would suffice to practice the invention.

FIG. 4 is a cut-away view of the rotor along lines 4—4 in FIG. 3. There are a plurality of mixing conduits 90 leading from each bore 88 to the mixing region 64 outside the rotor 62, shown as five mixing conduits 90 in the drawings. The conduits 90 lead directly from the bores 88 to the outside of the rotor, running perpendicular to the axis of the casing 2. There should not be too many mixing conduits 90 because that would increase the possibility of a "short circuit." Particularly, liquid polyelectrolyte might slip from the polyelectrolyte inlet 26 to the mixture outlet 12 without being completely mixed. This problem is avoided in the embodiment shown in the figures because the polyelectrolyte must travel some distance within the bores 88.

FIG. 5 is a perspective view in isolation of the rotor 62 in FIG. 3. The centers of the mixing conduits 90 leading from a particular bore 88 are equally spaced along the length of the rotor 62. The centers of the mixing conduits 90 are located in a straight line parallel to the axis of the rotor 62 running along the outer cylindrical wall of the rotor.

FIG. 6 shows a side elevational view in isolation of the sleeve 42. There are three slots 92 in the sleeve 42, each slot 92 being substantially rectangular and significantly longer in the axial direction than in the circumferential direction (approximately 10:1 in the preferred embodiment). The slots 92 are spaced apart equally along the axial direction of the sleeve 42.

FIG. 7 shows a front elevational view in isolation of the sleeve 42 of FIG. 6. As seen in FIG. 7, the slots 92 are equally spaced apart angularly (i.e., they are separated by 120° along the circumference of the sleeve).

Figure 8:
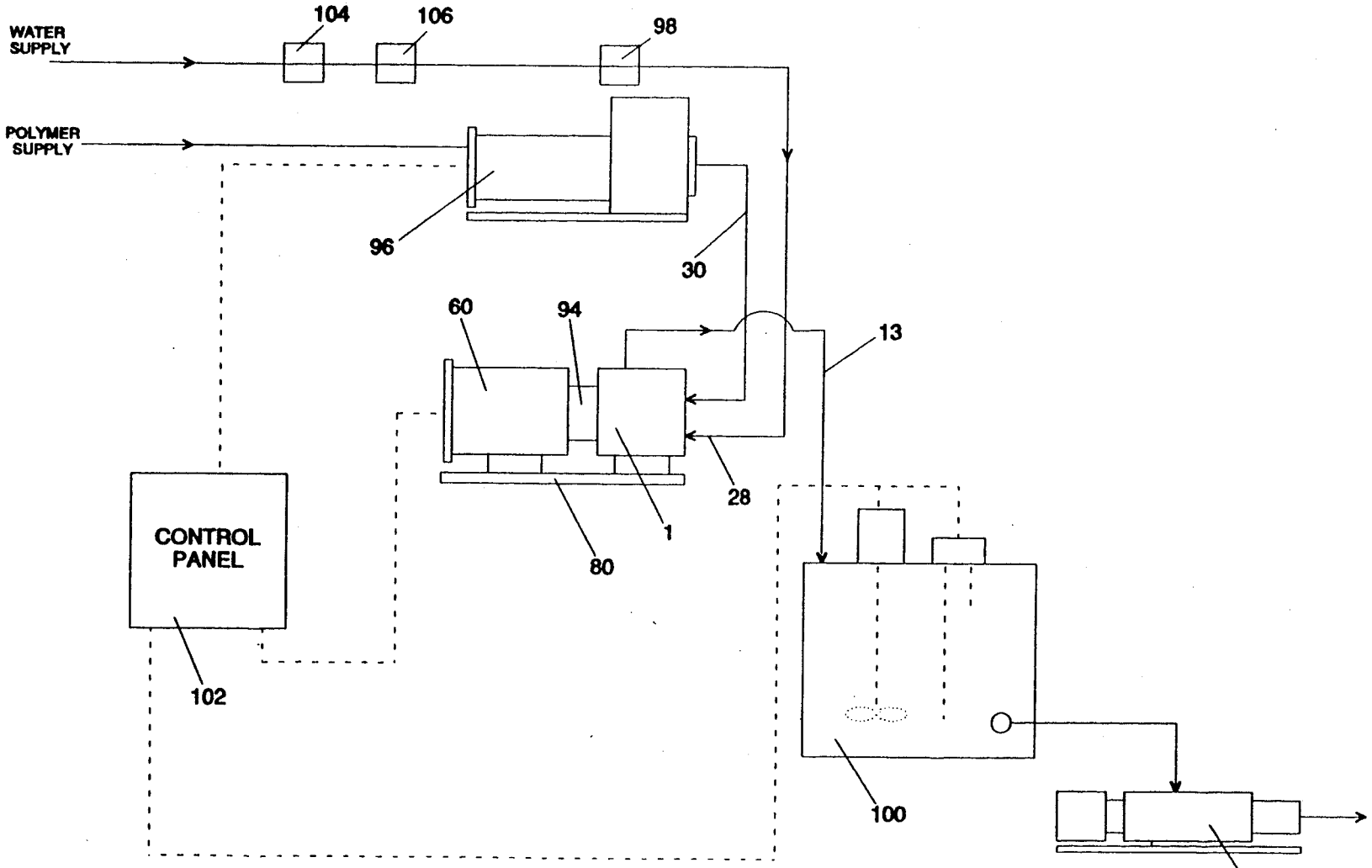
FIG. 8 is a schematic diagram of the mixing apparatus of FIG. 1 as it would be used in commercial operation for the mixing of water and a liquid polyelectrolyte.

FIG. 8 is a schematic diagram of the mixer 1 used in a polyelectrolyte processing and feeding system. The mixer 1 is mounted on the stand 80 next to the motor 60. The motor 60 is operatively engaged to the drive shaft 56 within a linkage casing 94. A first metering pump 96 is attached to the polyelectrolyte inlet tube 30 and controls the flow of the polyelectrolyte. The metering pump 96 is a positive displacement pump driven by a variable speed DC motor, but any adequate pumping means would suffice. A water supply typically of 0.25–30 gpm at 35 psig is attached to the water inlet connection 28.

In FIG. 8, the mixture outlet pipe 13 is shown as being attached to a holding tank 100 where the mixed fluid may be stored. A control panel 102, which may incorporate a control element such as a microprocessor, is in communication with the metering pump 96, the motor 60 and the holding tank 100 so that the proportion of mixing fluids can be controlled. Further, once the holding tank 100 is filled, the system is automatically shut off. From the holding tank 100, the mixed fluid is provided to a second metering pump 101 which supplies the mixed fluid to the process. Alternatively, the mixed fluid from the mixture outlet pipe 13 can be applied directly and continuously to the process, without the use of a holding tank.

To operate the system of FIG. 8, the motor 60 is turned on using the control panel 102, thereby rotating the drive shaft 56 in the mixer 1 (FIG. 1). The rotation of the drive shaft 56 causes the rotor 62, which is fixedly mounted to the drive shaft 56, to rotate. Water is input into the water inlet connection 28 at the pressure and flow rate. The water inlet rate is adjusted by a valve 104 on the water input connection 28. The water pressure is metered by a regulator valve 106 on the water input connector 28. The flow rate is metered by the throttling valve 98 on the water input connection 28.

Water passing through the water inlet connection 28 enters the water inlet 24. After the water passes through the first inlet 24, it enters the pre-rotor cavity 66 where the water comes in contact with the front plate 16, the sleeve 42 and the rotor 62. Because the rotor 62 is rotating, the water in the pre-rotor cavity 66 begins to swirl. The pressure of the entering water forces water to flow through the rotor 62, along the bores 88 and out the mixing conduits 90, filling the rotor chamber 6.

The fluid to be diluted, such as liquid polyelectrolyte, is pumped from a liquid polyelectrolyte supply by the metering pump 96 to the second inlet tube 30. The flow rate of the polyelectrolyte is carefully controlled from the control panel 102 that controls the metering pump 96. The polyelectrolyte flows through the second input tube 30, through the second inlet 26, and is bled into the swirling water of the pre-rotor cavity 66. Since polyelectrolytes have varying viscosities, the polyelectrolyte is introduced slowly into the swirling water, e.g., a volumetric proportion typically of 200 parts water for one part polyelectrolyte. This creates a thin stream of polyelectrolyte in the water thereby increasing the mixing surface area per unit volume between the polyelectrolyte and the water, thus expediting mixing.

As more water and polyelectrolyte are input into the pre-rotor cavity 66, the fluids are forced to the rear of the rotor chamber 6. The mixture flows out the mixture outlet pipe 13. This outlet flow decreases the pressure in the rear of the rotor chamber 6 and thereby increases the flow from the front to the rear of the rotor chamber 6.

The swirling mixture is forced from the pre-rotor cavity 66 into the bores 88 of the rotor 62 and along the length of the bores 88. As the mixture enters the bores 88, the edge of each bore 88 "shears" the mixture, breaking up globs of the fluid and, thereby, assisting the mixing of the fluids. Since the rotor 62 is rotating, the bores 88 also rotate. The rotation of the bores 88 forces the fluid in the bores to rotate about the center of the rotor 62. This rotation subjects the fluid to a centrifugal force that pushes the fluid out of the mixing conduits 90 into the mixing region 64 between the outer cylindrical wall of the rotor 62 and the sleeve 42. As the fluid enters the mixing region 64, it is sheared again by the edge of the mixing conduit 90 through which it is flowing. This shearing increases the mixing by breaking up droplets of polyelectrolyte that have not yet blended in with the water.

The flow within each bore 88 is highly turbulent, resulting in more mixing. The turbulence arises from friction with the walls of the bores 88, centrifugal force from the introduction of more fluid from the pre-rotor cavity 66, and the flow of some fluid out of the mixing conduits 90.

After exiting the mixing conduits 90, the fluid is in the mixing region 64 defined by the sleeve 42 and the rotor 62. The rotation of the rotor 62 creates friction that drags the fluid around the rotor chamber 6. The sleeve 42 is stationary. This creates a highly turbulent flow pattern which shears the fluid, breaking up polyelectrolyte droplets and increasing mixing.

As the mixture which had exited the mixing conduits 90 near the front 62*a* of the rotor 62 progresses toward the rear 62*b* of the rotor, it is mixed with mixture exiting the rear mixing conduits 90 of the rotor 62. This further increases mixing as mixtures from the different stages of the mixing process are blended together.

The fluid which exits the mixing conduits 90 is rotated around within the sleeve 42. As more fluid exits the mixing conduits 90, the fluid is forced out of the slots 92 in the sleeve 42. The edge of the slots 92 again shears the fluid. The fluid then progresses to the rear of the rotor chamber 6 within the mixing zone 44. As the fluid thus progresses, it is mixed with fluid that has exited from other slots 92 and subjected to turbulent flow. This further increases mixing.

Finally, near the rear of the rotor 6, the mixed fluid, which is substantially homogeneous at this stage, exits out of the mixture outlet 12 and is directed either directly to a chemical process or to the holding tank 100.

The liquid polyelectrolyte is fully mixed into the water because mixing occurs in different ways at many places in the mixer 1. Initially, the polyelectrolyte is diluted as it is slowly introduced into the water in the pre-rotor cavity 66 where the water is swirling at a high speed. Then, as the fluids enter the bores 88, they are sheared by the edge of each bore. Within the bore 88, the fluids are subjected to rotational turbulence, further increasing mixing. As the fluids enter and exit the mixing conduits 90, they are sheared again. In the mixing region 64 between the rotor 62 and the sleeve 42, the fluids are subjected to turbulence again as they are trapped between the rotating rotor 62 and the stationary sleeve 42. As the fluids flow toward the mixture outlet 12, they are mixed with other fluids exiting later conduits 90, resulting in further mixing. As the fluids flow through the slots 92 in the sleeve 42, they are sheared again. As the fluids flow rearwardly in the mixing zone 44 between the sleeve 42 and the wall of the casing 2, they are mixed with other fluids exiting later slots 92 in the sleeve. As the fluids flow in the mixing zone 44 toward the mixture outlet 12, they are also subjected to turbulence, resulting in more mixing. As a result of all this mixing, the exiting fluid is substantially homogeneous.

My invention is defined by the following claims.

I claim:

1. An apparatus for mixing at least a first fluid and a second fluid comprising:

a hollow cylindrical casing;

inlet means for injecting the first fluid and the second fluid into the hollow portion of the casing;

a drive shaft rotatably mounted coaxially within the casing;

a cylindrical rotor fixedly mounted on the drive shaft within the casing and coaxial with the casing;

a cylindrical sleeve fixedly mounted within the casing and coaxial with the casing wherein the sleeve encloses the rotor and the inlet means;

at least two cylindrical bores running through a significant portion of the length of the rotor wherein the bores are parallel to the axis of the casing;

at least one conduit leading from each bore to an outer wall of the rotor; and at least one slot in the sleeve.

2. The apparatus of claim 1 wherein the casing comprises a cylindrical tube having a first end and a second end, a front plate mounted on the first end, and a rear plate mounted on the second end.

3. The apparatus of claim 2 wherein the rotor is smaller axially than the tube such that a pre-rotor cavity is formed between the rotor and the front plate at the first end of the tube.

4. The apparatus of claim 2 wherein the inlet means is located in the front plate.

5. The apparatus of claim 2 also comprising outlet means for transporting the mixed fluids out of the mixing apparatus, wherein the outlet means is located in the cylindrical tube near the second end.

6. The apparatus of claim 1 wherein the rotor has six cylindrical bores, each bore having five conduits.

7. The apparatus of claim 1 having three slots in the sleeve, each slot being disposed 120° from an adjacent slot and the slots being positioned equally spaced along the length of the sleeve.

8. The apparatus of claim 1 wherein the inlet means comprises a first inlet for the first fluid and a second inlet for the second fluid, wherein the first inlet is disposed the same distance from the axis of the casing as the bores.

9. The apparatus of claim 1 wherein the first fluid is water and the second fluid is a liquid polyelectrolyte.

10. The apparatus of claim 1 wherein the bores in the rotor run the entire length of the rotor

11. The apparatus of claim 1 further comprising means for rotating the drive shaft.

12. An apparatus for mixing at least a first fluid and a second fluid comprising:

a hollow casing having a cylindrical chamber comprising a side wall, a first circular end wall and a second circular end wall;

a drive shaft located coaxially within the chamber;

means for rotating a drive shaft;

a cylindrical rotor mounted on the drive shaft and disposed coaxially within the chamber, said rotor being smaller in all dimensions than the chamber such that there is at least a pre-rotor cavity between the rotor and the first end wall;

inlet means for injecting the first fluid and the second fluid into the pre-rotor cavity;

a cylindrical sleeve mounted coaxially within the casing enclosing the rotor and the inlet means wherein a mixing region is formed between the rotor and the sleeve and a mixing zone is formed between the sleeve and the side wall;

at least one bore running parallel to the axis of the chamber and leading from the pre-rotor cavity to a point in the chamber distal to the pre-rotor cavity;

at least one conduit extending perpendicular to the axis of the chamber leading from the bore to the mixing region;

at least one slot in the sleeve; and an outlet means in the side wall located distal to the pre-rotor cavity.

13. The apparatus of claim 12 wherein the inlet means comprises a first inlet for the first fluid and a second inlet for the second fluid, wherein the first and second inlets are located on the first end wall.

14. The apparatus of claim 13 wherein the first inlet is located the same distance from the axis of the chamber as the bore.

15. Apparatus for mixing at least one fluid comprising:

a cylinder having a side wall, a front end and a rear end;

at least two bores running through the cylinder from the front end to the rear end parallel to the axis of the cylinder;

means for the injecting the fluid into the bores;

at least two conduits in the cylinder leading from each bore to outside the side wall of the cylinder,, wherein mixing of the fluid occurs in the bores as the cylinder rotates and also occurs as the fluid passes through the conduits to outside the side wall.

16. The apparatus of claim 15 further comprising a hollow casing enclosing the cylinder and wherein the conduits run perpendicular to the axis of the cylinder.

17. A fluid mixer comprising:

a hollow casing defining a cylindrical chamber, said chamber having a first end and a second end distal to the first end;

a drive shaft rotatably mounted on the casing coaxial with the chamber;

inlet holes for the fluids, the inlet holes being positioned at the first end of the chamber and an outlet hole positioned at a second end of the chamber;

a rotor, mounted on the drive shaft within the chamber, the rotor comprising a cylinder having bores running parallel to the axis of the chamber leading from the first end to the second end of the chamber, the rotor also having conduits leading from the bores to the chamber of the casing, wherein the rotor is placed between the first end and the second end of the chamber such that a substantial amount of the fluid passes through the bores and the conduits of the rotor as the fluids travel from the inlet holes to the outlet hole.

18. The mixer of claim 17 wherein the inlet holes are positioned the same distance from the axis of the chamber as the bores.

19. A method of mixing at least two fluids comprising:

introducing a first fluid into a second fluid thereby creating a combined fluid;

shearing the combined fluid by injecting the combined fluid into a bore located within a cylindrical rotor where the bore runs parallel to the axis of the rotor;

mixing the combined fluid within the bore by rotating the rotor;

mixing the combined fluid by transporting the combined fluid into a conduit leading from the bore, where the axis of the conduit is perpendicular to the axis of the bore;

shearing the combined fluid by transporting the combined fluid out of the conduit when the rotor is rotating;

mixing the combined fluid by disposing the combined fluid between the rotating rotor and a fixed cylindrical sleeve; and mixing the fluid by transporting the fluid through a slot in the sleeve.

20. The method of claim 19 also comprising the step of swirling the second fluid at the time the first fluid is introduced into the second fluid.

* * * * *